United States Patent [19]

Kendall-Tobias

[11] Patent Number: 4,597,034

[45] Date of Patent: Jun. 24, 1986

[54] SELF SPRUNG LAMP HOLDER

[75] Inventor: Michael W. Kendall-Tobias, Danbury, Conn.

[73] Assignee: The Perkin-Elmer Corporation, Norwalk, Conn.

[21] Appl. No.: 670,715

[22] Filed: Nov. 13, 1984

[51] Int. Cl.[4] ..... F21S 3/00

[52] U.S. Cl. ..... 362/217; 362/278; 362/289; 362/372; 313/310

[58] Field of Search ..... 362/217, 220, 263, 277, 362/278, 285, 287, 289, 320, 346, 359, 360, 362, 372, 419, 425, 430; 313/310

[56] References Cited

U.S. PATENT DOCUMENTS

| | | | |
|---|---|---|---|
| 1,377,161 | 5/1921 | Vanderbeek | 362/346 X |
| 2,268,713 | 1/1942 | Luti | 362/277 |
| 3,062,954 | 11/1962 | Goolsby | 362/360 |
| 3,361,925 | 1/1968 | Vollmer | 313/310 |
| 3,484,597 | 12/1969 | Schmidt | 362/217 X |
| 4,282,564 | 8/1981 | McJunkin, Jr. et al. | 362/217 |

*Primary Examiner*—W. R. Wolfe

*Attorney, Agent, or Firm*—E. T. Grimes; F. L. Masselle

[57] ABSTRACT

A self sprung holder device for a hollow cathode lamp of the type useful as a spectral radiation source for atomic absorption spectrometers. The holder is constructed from a sheet of flexible material bent along two lines to form an elongate tapered triangular housing open at one angle. An adjustment means is pivotally mounted at the rear or larger triangular opening of the housing. The adjustment means includes two thumb screws and a projecting arm member for aligning the lamp along two axes of movement with the front end portion of the lamp being pivoted about one or more integral housing fulcrum points.

14 Claims, 3 Drawing Figures

SELF SPRUNG LAMP HOLDER

FIELD OF INVENTION

The invention relates to an improved hollow cathode lamp mounting device and, in particular, to a holder and alignment device of improved construction and utility.

BACKGROUND OF THE INVENTION

Hollow cathode lamps and various types of holders therefore have been used for many years.

Some typical prior art lamp holders, as used in atomic absorption spectrophotometers, comprise a right angle support plate having two helical type springs each suspended diagonally, a pair of adjustment screws each engaging the lamp and a pair of discrete post like (fulcrum) members affixed to the support plate. These devices have numerous deficiencies such as being relatively sumptuous in component parts, are subject to failure of their components such as discrete springs, and are relatively expensive to manufacture.

A typical hollow cathode lamp is illustrated and described in detail in U.S. Pat. No. 3,361,925 issued Jan. 2, 1968 to John W. Vollmer.

In contrast to the prior art, the present invention provides a self sprung lamp holder which combines the functional and structural features and advantages of a support member, a bias means and a plurality of fulcrum points in a unitary component which is relatively inexpensive to manufacture. The support member is formed of flexible material and has a tapered triangular configuration open along one angle. The triangular structure is dimensioned to accommodate the longitudinal insertion of a hollow cathode lamp. The front portion of the lamp is yieldably constrained at three points of contact about its frontal circumference by engagement with a respective wall member of the triangular structure. One or more of the constraining points of contact also function as a fulcrum point. A manual adjustment means is provided to urge a rear end portion of the lamp into sliding engagement with and in opposition to the bias of an inwardly bent wall member of the triangular structure.

SUMMARY OF THE INVENTION

Apparatus for supporting and aligning a hollow cathode lamp of the type used in atomic absorption spectrophotometers comprising:

a housing formed of flexible or spring like material to have a tapered or conical triangular configuration being defined by a central wall and two inwardly bent or sloped walls each having a cantilevered free elongate edge defining an open angle of the triangular housing, and having an internal cavity with a front and a rear generally triangular shaped orifice extending into said cavity and being dimensioned to accommodate the longitudinal insertion of the lamp into the cavity while extending without the housing at the front and rear orifices, said front orifice each yieldably constrain or contact a portion of the periphery of the lamp;

manual adjustment means mounted to said housing to enable selective disposition of the rear end portion of the lamp in opposition to the leaf spring like bias of one of the inwardly sloped walls of the housing.

Accordingly, it is an object of the present invention to provide apparatus for aligning the spectral radiation of a hollow cathode lamp.

Another object of the present invention is to provide a relatively inexpensive lamp holder.

Another object of the present invention is to provide a new and improved hollow cathode lamp holder having a high level of reliability, efficiency and constructural simplicity.

Another object of the present invention is to provide a new and improved means of adjusting the beam direction of a hollow cathode lamp.

Another object of the present invention is to provide an integral fulcrum point and lamp holder.

Another object of the present invention is to provide an integral biasing means and lamp holder housing.

Another object of the present invention is to provide a self sprung lamp holder.

It is yet another object of the present invention to provide a self sprung lamp holder which combines the functional and structural features of a support housing, a bias means and one or more fulcrum points in a unitary component which is relatively inexpensive to manufacture.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENT

Figures 1, 2:
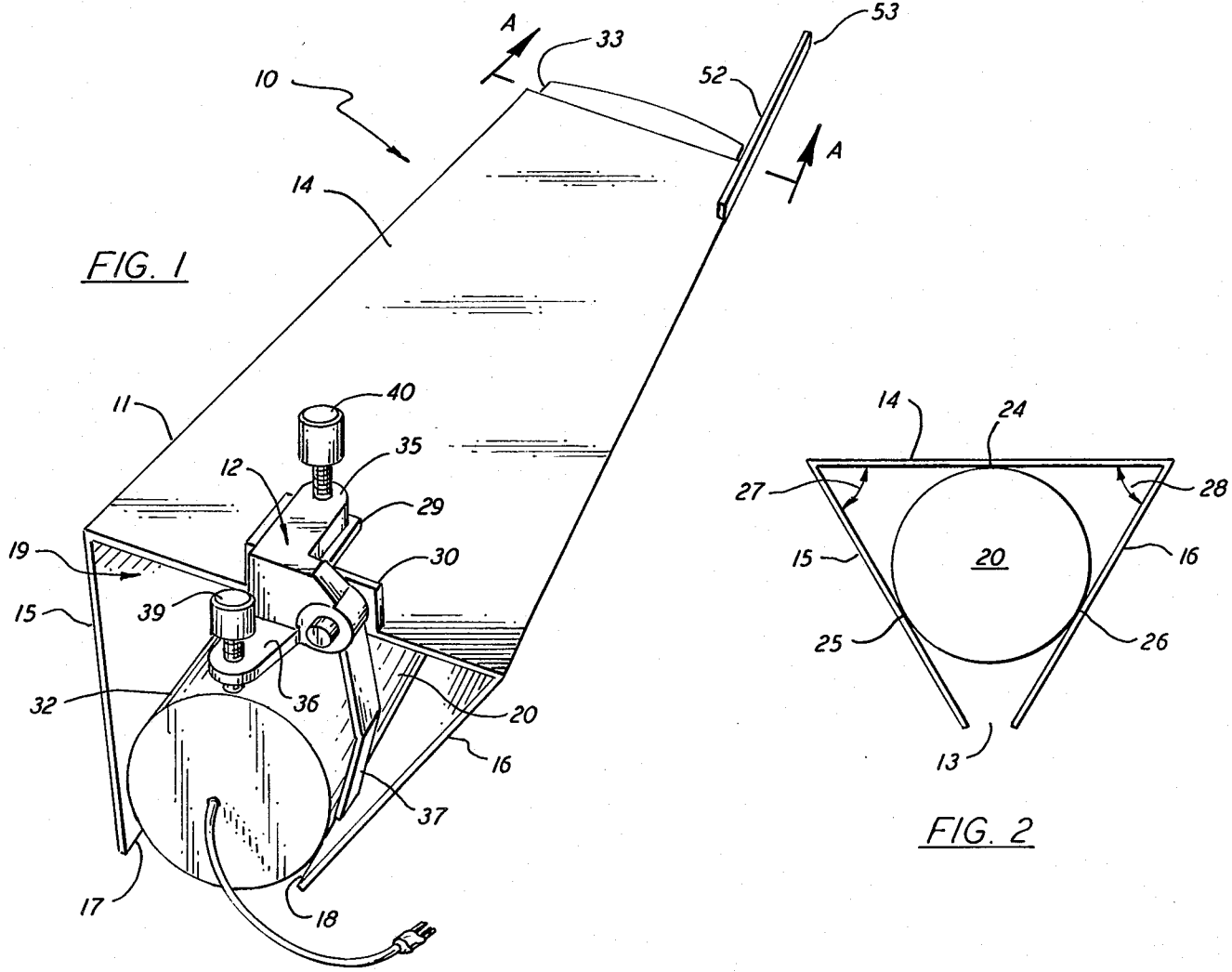
FIG. 1 is a perspective view of the lamp holder according to the present invention.
FIG. 2 is a view taken substantially at section A—A of FIG. 1 and shows in detail the frontal contracts of the lamp with each wall of the holder.
Figure 3:
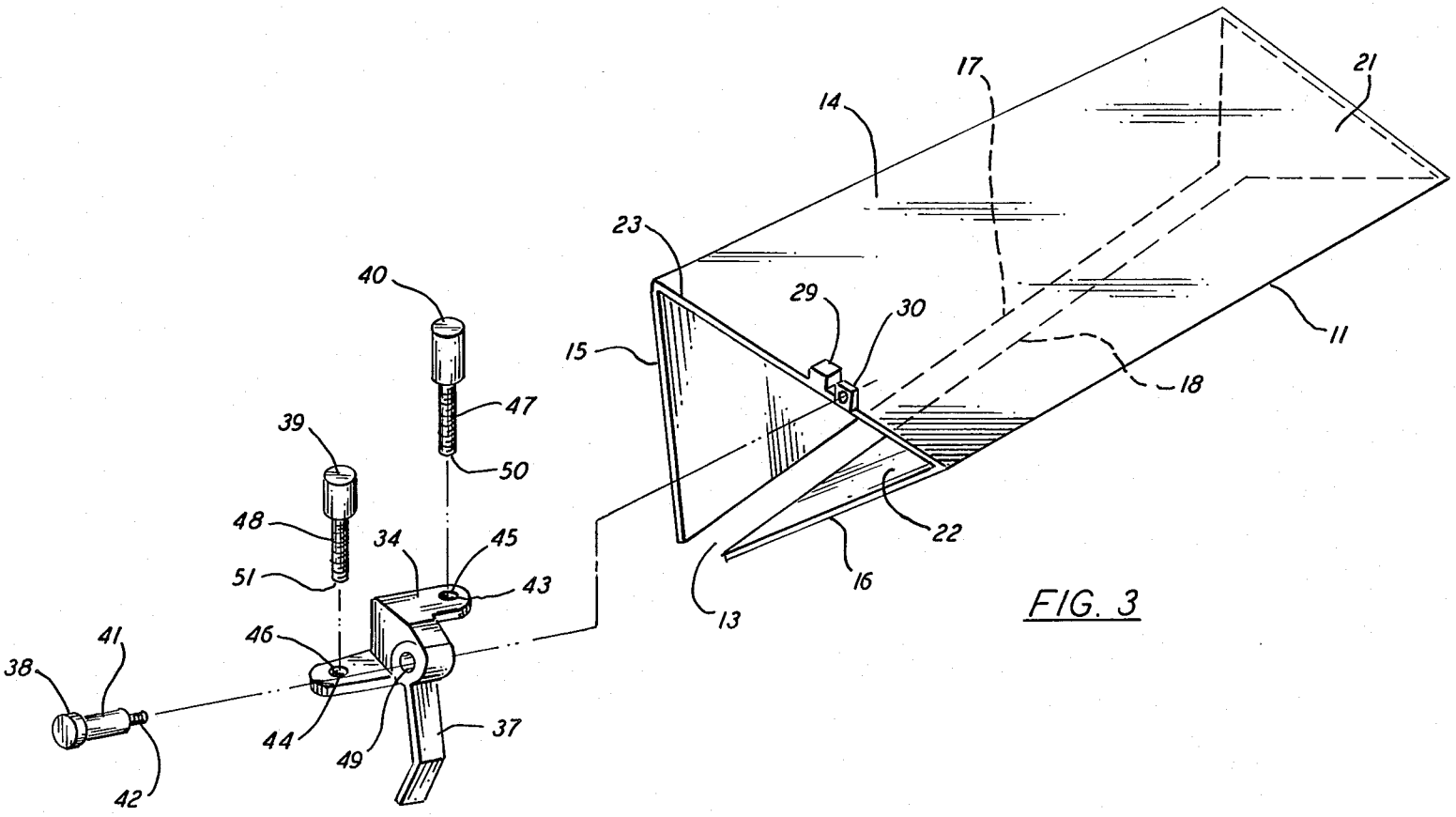
FIG. 3 is an exploded isometric view of the self sprung lamp holder shown in FIG. 1.

Referring to the drawings, particularly FIGS. 1, 2 and 3, there is shown a lamp holder 10 constructed in accordance with the invention. The lamp holder 10 generally comprises a support housing 11 and an adjustment member 12. The constituent parts of the lamp holder 10 may be formed, for example, of any suitable metal or plastic or combination thereof.

The support housing 11 is formed of flexible material such as sheet aluminum or steel and has a cone or tapered triangular configuration open along one angle 13. The triangular housing 11 is defined by a central or top wall 14 and two downwardly and inwardly sloping side walls 15 and 16. The open angle 13 of the housing 11 is defined by the elongate edges 17 and 18 of side walls 15 and 16, respectively. Top wall 14 and side walls 15 and 16 are diminished to form an internal cavity 19 to accommodate the longitudinal insertion or placement of a hollow cathode lamp 20.

Top wall 14 and/or side wall 15 and/or side wall 16 are tapered such that front orifice 21 has a generally equilateral triangular configuration of smaller dimension than rear (triangular) orifice 22. Front orifice 21 is dimensioned such that an internal surface portion of each wall 14, 15 and 16 contacts or engages a portion of the lamp 20 about its frontal circumference. For example, with front orifice 21 being approximately equilateral and equiangular, lamp 20 is held or constrained between three approximately 120° spaced apart points 24, 25 and 26. The angles 27 and 28 formed between top wall 14 and walls 15 and 16, respectively, are selected such that slight outward spreading apart of walls 15 and 16 results with insertion of lamp 20. In this manner, the front end of lamp 20 is yieldably constrained and mounted under a leaf spring like bias.

The rear or wide edge portion 23 of top wall 14 has an upwardly and bent over ledge member 29, and a pivot mounting plate 30. Ledge member 29 and pivot mounting member 30 may be integrally formed with support housing 11. Pivot mounting member 20 has a pivot bolt receiving hole 31 with internal screw threads (not shown). Rear orifice 22 is dimensioned to be larger than the cross sectional area of lamp 20 to enable end portion 32 to have a two axis freedom of movement within orifice 22. With front portion 33 pivotable about fulcrum points 24 and 26, (X,Y) movement of the rear end 32 relative to the front end 33 of lamp 20 may be effected to adjust, alter or align the axial orientation of lamp 20.

It should be noted that the exact dimension and taper of the support housing 11 and its constituent top and side walls are not critical elements of the invention and may be determined empirically without inventive effort. Likewise, the angle (of bend) between each side wall and the top wall may be empirically determined. However, an angle of 60° is generally preferable and functioned satisfactorily with a working embodiment of the invention.

Adjustment member 12 is of conventional design and basically comprises a body portion 34, upper ledge 35, lower ledge 36, arm member 37, pivot bolt 38 and two thumb scews 39 and 40. Body portion 34, upper and lower ledges 35, 36, and arm member 37 may be integrally formed. Pivot bolt 38 has an intermediate pivot surface 41 an end portion 42 being of reduced diameter with eternal threads for mating with the internal threads about hold 31. Upper and lower ledges 35 and 36 each have a bolt mounting hole 43 and 44, respectively. Each bolt mounting hold 43 and 44 has internal threads 45 and 46 dimensioned to matingly receive threaded ends 47 and 48 of thumb screws 40 and 39, respectively.

Adjustment member 12 is pivotally mounted to support housing 11 by means of bolt 38 being inserted through pivot hole 49 and screwed into hole 31 of pivot mounting plate 30.

With adjustment member 12 mounted to support housing 11 as shown in FIG. 1, thumb screw 40 may be rotated to cause its bottom surface 50 to abut (not shown) the upper surface of ledge member 29. Clockwise and counterclockwise rotation of thumb screw 40 causes upper ledge member 36 to generally move upwardly and downwardly, respectively, relative to ledge member 29. This upward and downward movement of upper ledge member 36 causes adjustment member 12 to rotate clockwise and counterclockwise respectively. Clockwise and counterclockwise rotation of adjustment member 12 causes arm member 18 to generally sweep or move transversely back and forth across rear orifice 22. Thumb screw 39 is also manually rotatably clockwise and counterclockwise which causes its lower surface 51 (not shown) to move downwardly and upwardly, respectively.

A mounting beam or bracket 52 may be affixed in a conventional manner to support housing 11. Beam 52 has a cantilevered free end 53 which may be held in a clamp like mechanism on the atomic absorption spectrometer (not shown) for mounting support housing 11 thereto.

As noted above, with hollow cathode lamp 20 inserted into support housing 11, front end 33 is yieldably supported and pivotable about symmetrical fulcrum points 24, 25 and 26. The rear end 32 of lamp 20 is inserted and adjustably constrained between arm 18, the bottom surface 51 of thumb screw 39 and the inner sloped surface of wall 15.

OPERATION

With clockwise rotation of thumb screw 40 the upper ledge 36 is elevated relative to platform 29, which causes arm 18 and, coincidentally, the rear end 32 of lamp 20 to be displaced transversely to the left (see FIG. 1) in opposition to the leaf spring like bias of wall 15.

With counterclockwise rotation of thumb screw 40 the upper ledge 36 is lowered, which causes arm 18 to be displaced transversely to the right. As arm 18 is moved to the right, the spring bias of wall 15 urges the rear end 32 to the right which maintains the periphery of lamp 20 in engagement with arm 18.

As the rear end 32 of lamp 20 is displaced transversely from side to side, its front end 33 is pivoted about or between fulcrum points 25 and 26 (see FIG. 2).

Depending on the rigidity of top wall 14, with an outward flexing of wall 15, a corresponding concavity like flexing of a rear portion of top wall 14 may be effected.

With clockwise rotation of thumb screw 39, the rear end 32 of lamp 20 surged downwardly in opposition to the bias of walls 15 and 16.

A counterclockwise rotation of thumb screw 39 causes it to be elevated relative to lower ledge 35. As thumb screw 39 is elevated upwardly, the somewhat upwardly and inwardly directed bias of sloped wall 15 and 16 causes the rear end 32 of lamp 20 to slide or move upwardly between wall 16 and wall 15 under the constraining or restricting influence of thumb screw 39.

As the rear end 32 of lamp 20 is displaced upwardly and downwardly, its front end 33 is pivoted about fulcrum point 24 and between fulcrum or support points 25 and 26.

While there has been shown what is considered to be the preferred embodiment of the invention, it is desired to secure in the appended claims all modifications as fall within the true spirit and scope of the invention.

What is claimed is:

1. A lamp holder of the type as used in conjunction with discrete adjustment means to mount and align hollow cathode lamps in atomic absorption spectrometers comprising:

a housing having a tapered elongate triangular configuration open at one angle, said housing having an interior hollow cathode lamp receiving cavity and a plurality of wall portions defining a front and a rear generally triangularly shaped orifice each extending into the interior hollow cathode lamp receiving cavity;

said rear orifice being of substantially larger dimension than the front orifice.

2. A lamp holder of the type as used in conjunction with discrete adjustment means to mount and align hollow cathode lamps in atomic absorption spectrometers comprising:

a housing having a tapered elongate triangular configuration open at one angle, said housing having an interior hollow cathode lamp receiving cavity and a plurality of wall portions defining a front and a rear generally triangularly shaped orifice each extending into the interior hollow cathode lamp receiving cavity;

adjustment means mounted on said housing to enable biaxial displacement of a rear end of the hollow cathode lamp.

3. A self sprung lamp holder and alignment device for a hollow cathode lamp, in combination comprising:

an integral housing means (11) having an elongate tapered triangular shape defined by center wall (14) and a pair of spaced inwardly sloping side walls (15, 16) having proximal cantilevered free longitudinal edges (17, 18) defining an open angle (13) of said triangular shaped housing means, each of said walls (14, 15 & 16) having interior source members defining an interior lamp receiving cavity (19) and a front orifice (21) and a rear orifice (22), said interior surface members dimensionally define the front orifice to have an equilateral triangular configuration with a surface point (24, 25 & 26) for effecting pivotal mounting about a frontal portion (33) of the hollow cathode lamp (20), said interior surface members dimensionally defining the rear orifice to have a triangular configuration to enable biaxial movement of a rear portion (32) of the hollow cathode lamp within said rear orifice, said pair of side walls (15, 16) having a leaf spring like flexibility; and adjustment means (12) mounted to said housing means to enable selective biaxial displacement of the rear end portion of the hollow cathode lamp within the rear orifice.

4. A self sprung lamp holder as in claim 14, wherein:

the adjustment means comprises a body portion (34), an upper ledge (35), a lower ledge (36), an arm member (37), and a pair of thumb scews (39, 40), said adjustment means being pivotally mounted about the rear orifice of said housing means, said arm member being configured for urging a rear portion of the hollow cathode lamp into engagement with one of said side walls (15) causing it to be flexibly bent outwardly, one of said thumb screws (40) being manually actuatable for causing said arm member to laterally displace the rear portion of the hollow cathode lamp under the bias effected by the outwardly bent side wall, the other thumb screw (39) being manually actuatable for selectively causing an upward and downward displacement of the rear portion of the hollow cathode lamp under the bias effected by the outwardly bend side wall.

5. A lamp holder of the type as used in conjunction with discrete adjustment means to mount and align a hollow cathode lamp in atomic absorption spectrometers comprising:

housing means formed of flexible material to have a conical triangular configuration being defined by a top wall and a pair of spaced side walls each being downwardly and inwardly sloped and having a respective bottom elongate edge, said elongate edges defining an elongate open angle of the triangular shaped housing means, said housing means having a internal cavity and an interior wall surface portions forming a front and a rear triangularly shaped orifices extending into said internal cavity, said internal cavity and said front and rear orifices being dimensioned for accommodating the hollow cathode lamp with its front end projecting without said front orifice and its rear end projecting without said rear orifice, said interior wall surface portions defining the front orifice being dimensioned to flexibly engage three approximately equidistant circumferential surface points about a frontal portion of the hollow cathode lamp, said interior wall surface portions defining the rear orifice being dimensioned to enable displacement of the rear end of the hollow cathode lamp along two axis of movement about said rear orifice.

6. A lamp holder as in claim 5 wherein:

the housing means is formed from a flat sheet of aluminum bent along two lines to effect said pair of downwardly sloping leaf spring like side walls.

7. A lamp holder as in claim 5 wherein:

the wall surface portions defining the front orifice are substantially of equal length and comprising an equilateral triangular configuration.

8. A lamp holder as in claim 5 wherein:

the wall surface portions defining the front orifice engage the peripheral surface of the hollow cathode lamp to effect a pivotal mounting of the frontal end of the hollow cathode lamp.

9. A lamp holder of the type as used in conjunction with discrete adjustment means to mount and align hollow cathode lamps in atomic absorption spectrometers comprising:

a housing having a tapered elongate triangular configuration open at one angle, said housing having an interior hollow cathode lamp receiving cavity and a plurality of wall portions defining a front and a rear generally triangularly shaped orifice each extending into the interior hollow cathode lamp receiving cavity;

said front orifice being dimensioned to flexibly and snugly engage a plurality of peripheral surface portions about the hollow cathode lamp when inserted longitudinally into the front orifice.

10. A lamp holder as in claim 9, wherein:

the housing is formed of flexible material.

11. A lamp holder as in claim 9, wherein:

the housing comprises a unitary structure.

12. A lamp holder as in claim 9, wherein:

the housing comprises a center wall and two spaced inwardly sloping side walls having juxtaposed free longitudinal edges forming the open angle of the triangularly shaped housing.

13. A lamp holder as in claim 9, wherein:

the front orifice has an equilateral triangular configuration dimensioned to engage three approximately 60° spaced apart surface portions about the peripheral surface of the hollow cathode lamp.

14. A lamp holder as in claim 13, wherein:

each wall portion of said housing defining the front orifice has a surface portion effecting both a mounting engagement and fulcrum point of the hollow cathode lamp.

* * * * *